US011031718B2

(12) United States Patent
Miyamura et al.

(10) Patent No.: US 11,031,718 B2
(45) Date of Patent: Jun. 8, 2021

(54) CONNECTOR WITH A HOUSING HAVING A LOCKING LANCE WITH A RESTRICTING PORTION TO RESTRICT OUTWARD DEFORMATION OF THE LOCKING LANCE

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tetsuya Miyamura, Mie (JP); Yasuo Omori, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/634,734

(22) PCT Filed: Jul. 26, 2018

(86) PCT No.: PCT/JP2018/028015

§ 371 (c)(1),
(2) Date: Jan. 28, 2020

(87) PCT Pub. No.: WO2019/035331

PCT Pub. Date: Feb. 21, 2019

(65) Prior Publication Data

US 2020/0212617 A1 Jul. 2, 2020

(30) Foreign Application Priority Data

Aug. 16, 2017 (JP) ..... JP2017-157076

(51) Int. Cl.
*H01R 13/422* (2006.01)
*H01R 13/641* (2006.01)

(52) U.S. Cl.
CPC ..... *H01R 13/4223* (2013.01); *H01R 13/641* (2013.01)

(58) Field of Classification Search
CPC ..... H01R 13/4223
See application file for complete search history.

(56) References Cited

U.S. PATENT DOCUMENTS

| | | | | |
|---|---|---|---|---|
| 9,431,744 | B2 * | 8/2016 | Kataoka | H01R 13/426 |
| 2006/0035536 | A1 | 2/2006 | Sai | |
| 2010/0009568 | A1 | 1/2010 | Ichio et al. | |

FOREIGN PATENT DOCUMENTS

| | | |
|---|---|---|
| JP | 2006-054141 | 2/2006 |
| JP | 2006-236678 | 9/2006 |

(Continued)

OTHER PUBLICATIONS

International Search Report dated Oct. 16, 2018.

*Primary Examiner* — Ross N Gushi
(74) *Attorney, Agent, or Firm* — Gerald E. Hespos; Michael J. Porco; Matthew T. Hespos

(57) ABSTRACT

It is aimed to prevent improper deformation of a locking lance. A connector (1) includes a housing (10) having an insertion space (11), an terminal module (27) insertable into the insertion space (11), a locking lance (16) formed in the housing (10) such that an outer surface (17S) is exposed to outside of the housing (10) and configured to be resiliently deformed toward the outer surface (17S) in the process of inserting the terminal module (27) into the insertion space (1) and resiliently return to retain the terminal module (27) when the terminal module (27) is properly inserted, and restricting portions (23) formed on the locking lance (16) and configured to restrict a displacement of the locking lance (16) toward the insertion space (11) by being locked to the housing (10).

12 Claims, 14 Drawing Sheets

(56) References Cited

FOREIGN PATENT DOCUMENTS

| | | |
|---|---|---|
| JP | 2010-040508 | 2/2010 |
| JP | 2014-017101 | 1/2014 |

* cited by examiner

CONNECTOR WITH A HOUSING HAVING A LOCKING LANCE WITH A RESTRICTING PORTION TO RESTRICT OUTWARD DEFORMATION OF THE LOCKING LANCE

BACKGROUND

Field of the Invention

The invention relates to a connector.

Related Art

Japanese Unexamined Patent Publication No. 2006-054141 discloses a connector in which a contact is inserted into a contact accommodating cavity formed in a housing and retained by being locked by a locking lance formed in the contact accommodating cavity. The locking lance is deformed resiliently due to interference with the contact in the process of inserting the contact, and resiliently returns to lock the contact when the contact is inserted properly.

In the above-described connector, the locking lance is accommodated inside the housing. To reduce a height of this connector, a structure has been considered in which a part of the housing covering the locking lance is removed to expose the locking lance on the outer surface of the housing. However, if the locking lance is exposed on the outer surface of the housing, the locking lance may be pressed into the contact accommodating cavity and plastically deformed when an external matter comes into contact with the outer surface of the locking lance.

The invention was completed on the basis of the above situation and aims to prevent improper deformation of a locking lance.

SUMMARY

The invention is directed to a connector with a housing having an insertion space, and an inserting member is insertable into the insertion space. A locking lance is formed in the housing such that an outer surface is exposed to outside of the housing. The locking lance is deformed resiliently toward the outer surface in the process of inserting the inserting member into the insertion space and returns resiliently to retain the inserting member when the inserting member is inserted properly. A restricting portion is formed on the locking lance and restricts a displacement of the locking lance toward the insertion space by being locked to the housing.

The restricting portion is locked to the housing even if the outer surface of the locking lance is pressed. Thus, there is no possibility that the locking lance is deformed improperly toward the insertion space.

The locking lance may be cantilevered substantially parallel to an inserting direction of the inserting member, and the restricting portion may be disposed at a position closer to an extending end part than a base end part of the locking lance in an extending direction of the locking lance. If the locking lance is deformed resiliently toward the outer surface due to interference with the inserting member, the amount of deflection of the locking lances is maximized at the base end part. Thus, if the restricting portion is formed on the base end part of the locking lance, the flexural rigidity of the base end part of the locking lance increases and resistance when the inserting member is inserted increases. Accordingly, the restricting portion of certain embodiments is at the position closer to the extending end part than the base end part of the locking lance in the extending direction. In this way, the flexural rigidity when the locking lance is resiliently deformed does not increase, and the resistance when the inserting member is inserted also does not increase.

The outer surface of the locking lance may be disposed at a position retracted from an outer surface of the housing when the locking lance is in a free state without being resiliently deformed. According to this configuration, external matter is less likely to interfere with the outer surface of the locking lance.

The locking lance may be cantilevered substantially parallel to the inserting direction of the inserting member, and two of the restricting portions may project from both sides of the locking lance. According to this configuration, there is no possibility that the locking lance is inclined when the restricting portion comes into contact with the housing to restrict resilient deformation of the locking lance.

A detection groove may be formed in the outer wall surface of the housing facing the restricting portion displaced according to resilient deformation of the locking lance. According to this configuration, the locking lance is deformed resiliently toward the outer surface in a state where the inserting member is inserted insufficiently. If a mating member is fit along the detection groove in this state, the mating member butts against the restricting portion. Thus, it can be detected by this butting that the inserting member is inserted insufficiently.

The locking lance may be cantilevered substantially parallel to the inserting direction of the inserting member, and a guide groove may be formed in the outer surface of the housing extending toward the extending end part of the locking lance. According to this configuration, the locking lance can be disengaged from the inserting member by sliding a tool along the guide groove and slipping the tool under the extending end part of the locking lance. Therefore work efficiency is good.

DETAILED DESCRIPTION

First Embodiment

Figure 1:
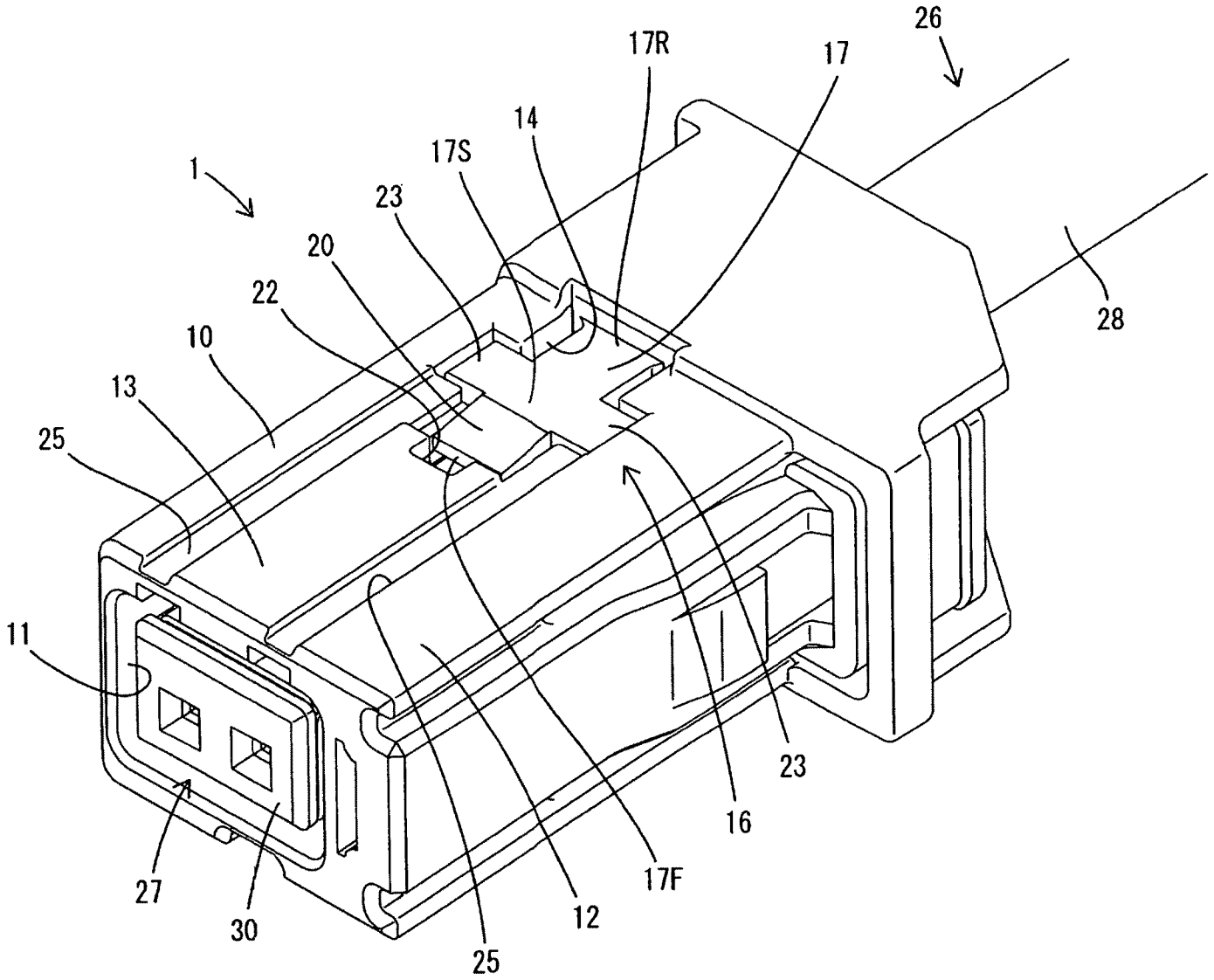
FIG. 1 is a perspective view of a connector in a state where a terminal module is properly inserted in a housing in a first embodiment.
Figure 2:
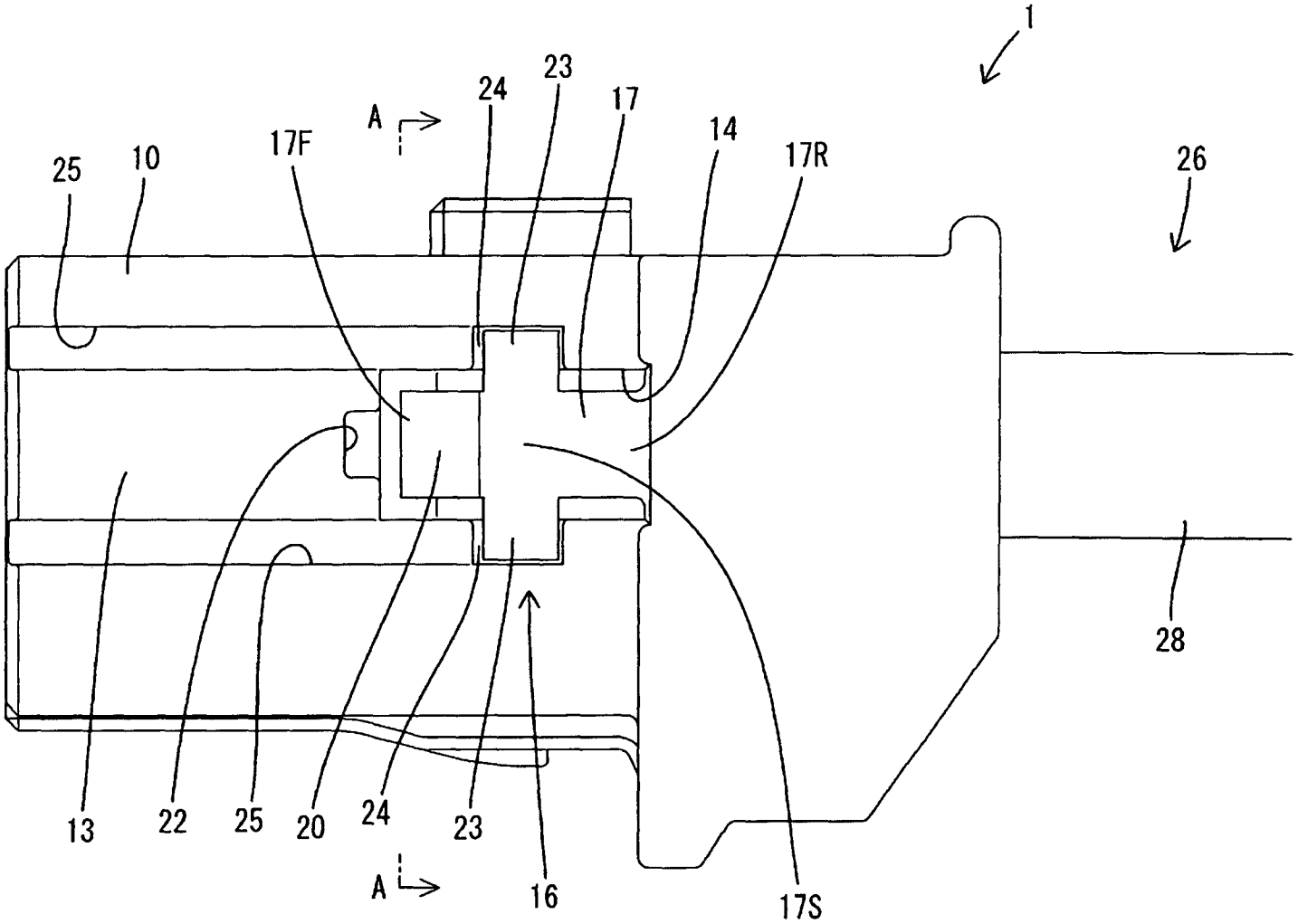
FIG. 2 is a plan view of the connector in the state where the terminal module is properly inserted in the housing.
Figure 3:
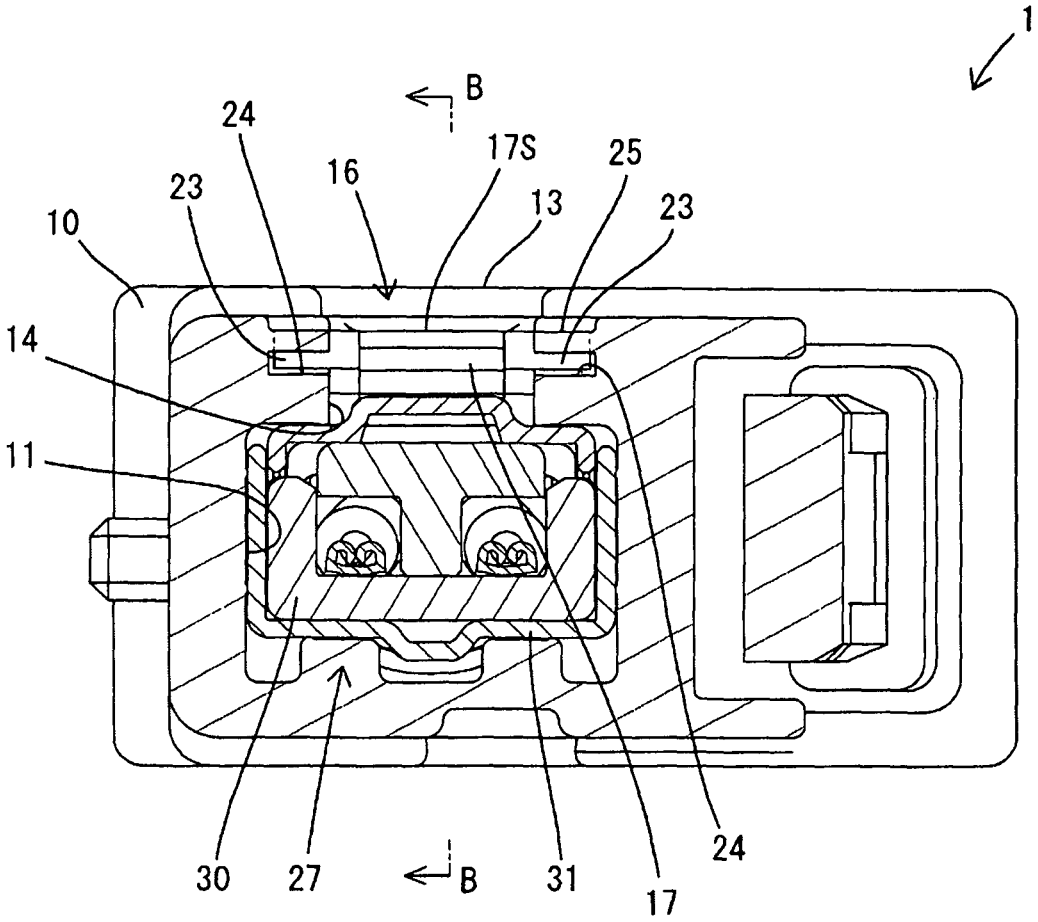
FIG. 3 is a section along A-A of FIG. 2.
Figure 4:
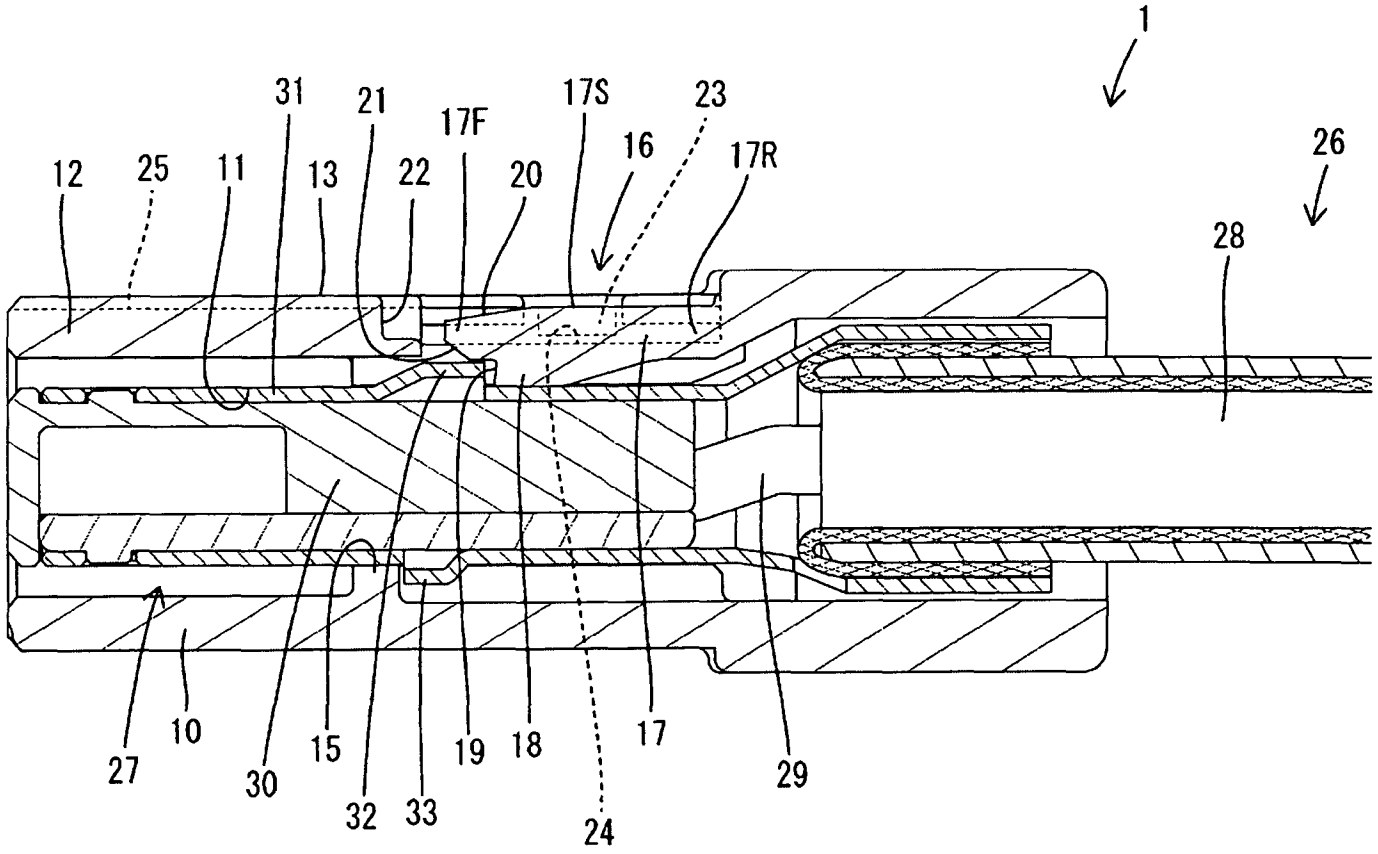
FIG. 4 is a section along B-B of FIG. 3.
Figure 5:
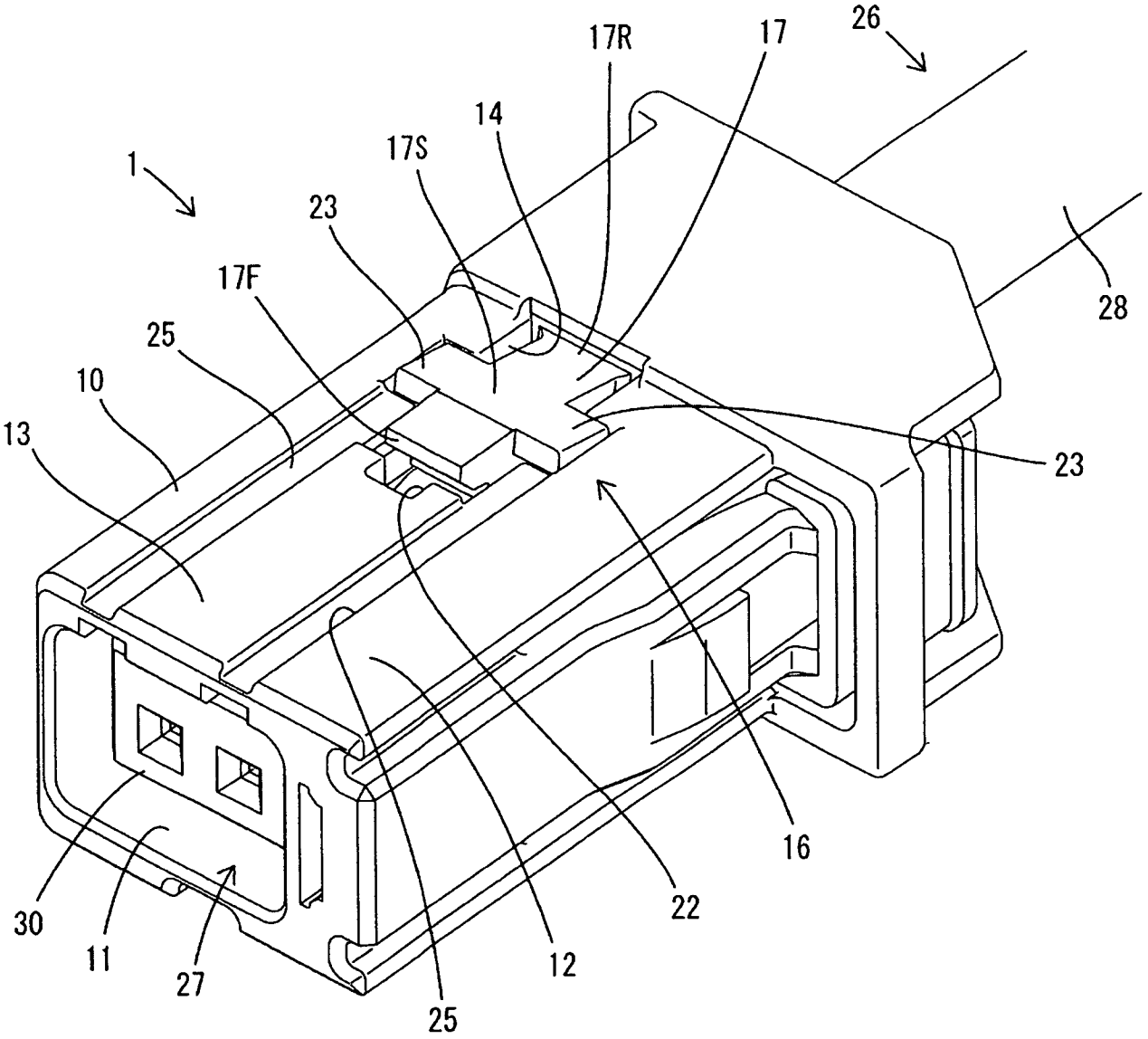
FIG. 5 is a perspective view of the connector in a state where the terminal module is insufficiently inserted.
Figure 6:
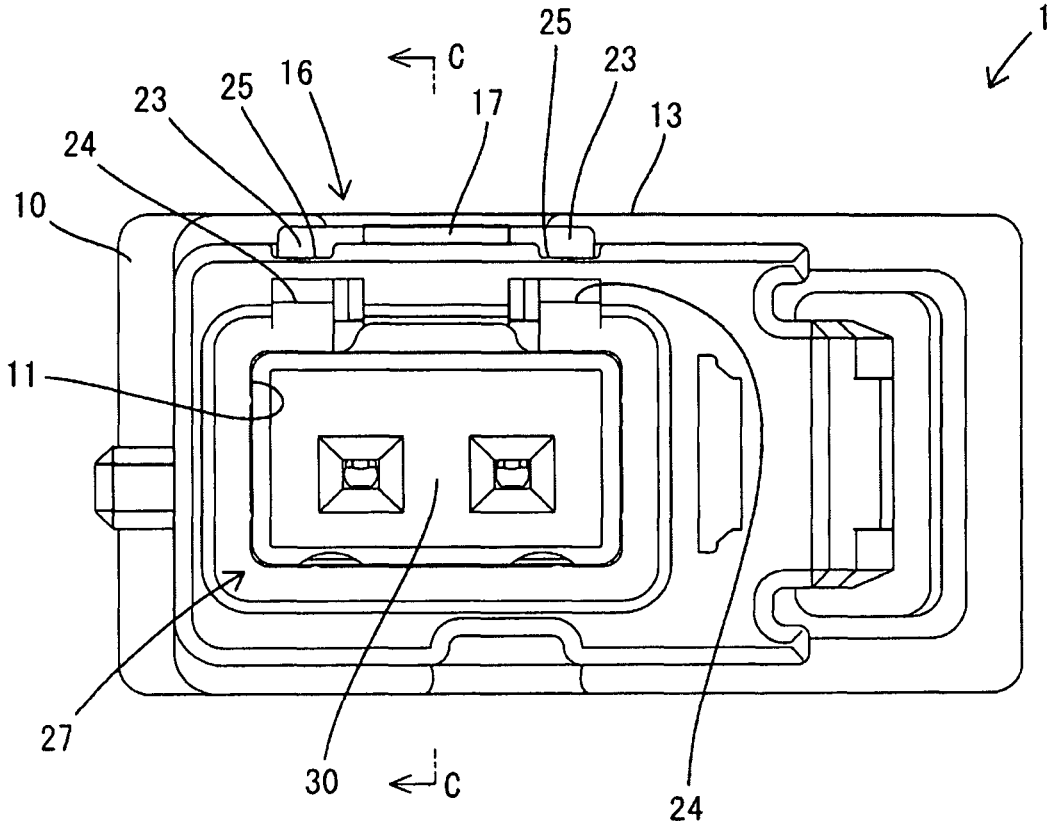
FIG. 6 is a front view of the connector in the state where the terminal module is insufficiently inserted.
Figure 7:
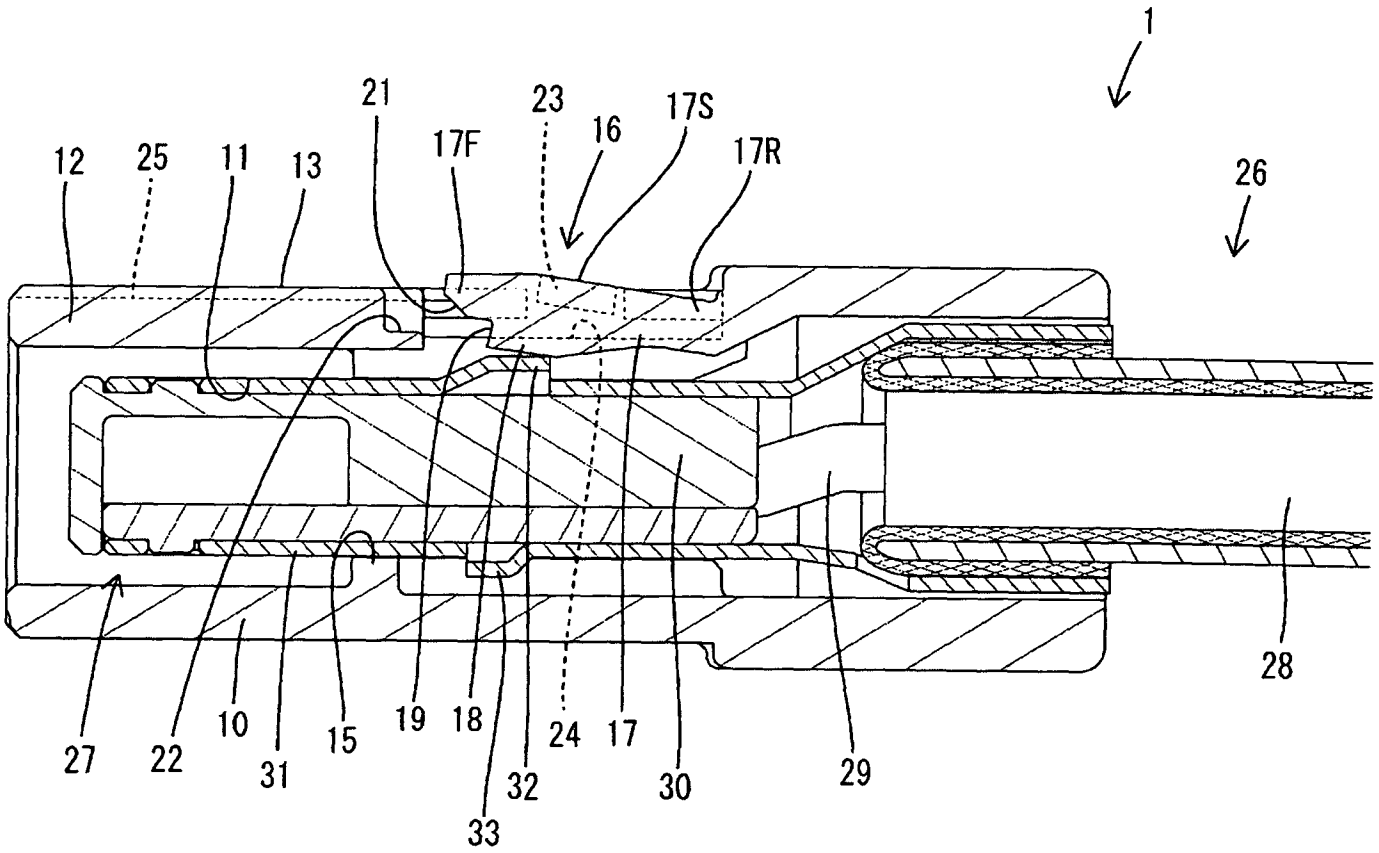
FIG. 7 is a section along C-C of FIG. 6.
Figure 8:
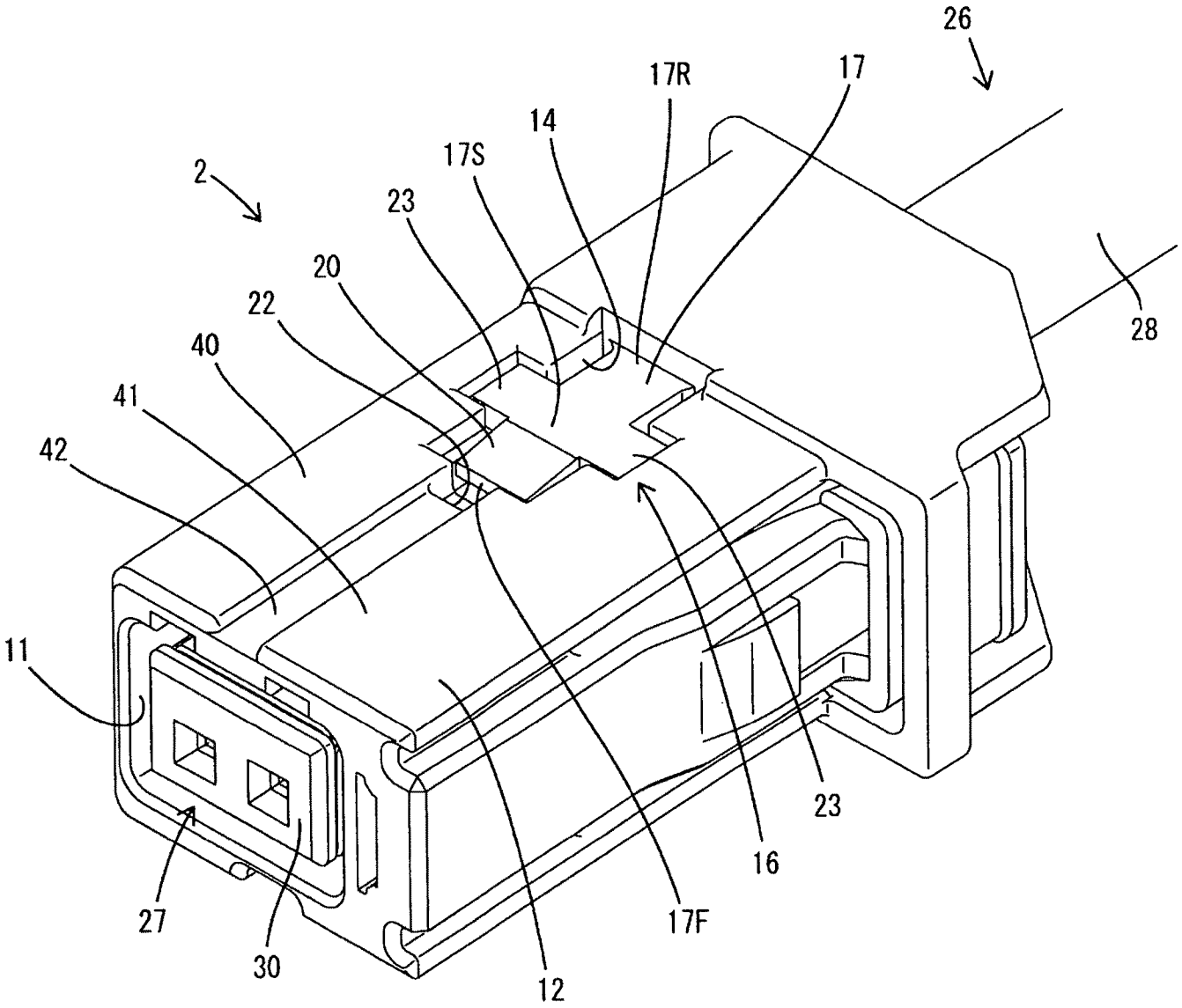
FIG. 8 is a perspective view of a connector in a state where a terminal module is properly inserted in a housing in a second embodiment.
Figure 9:
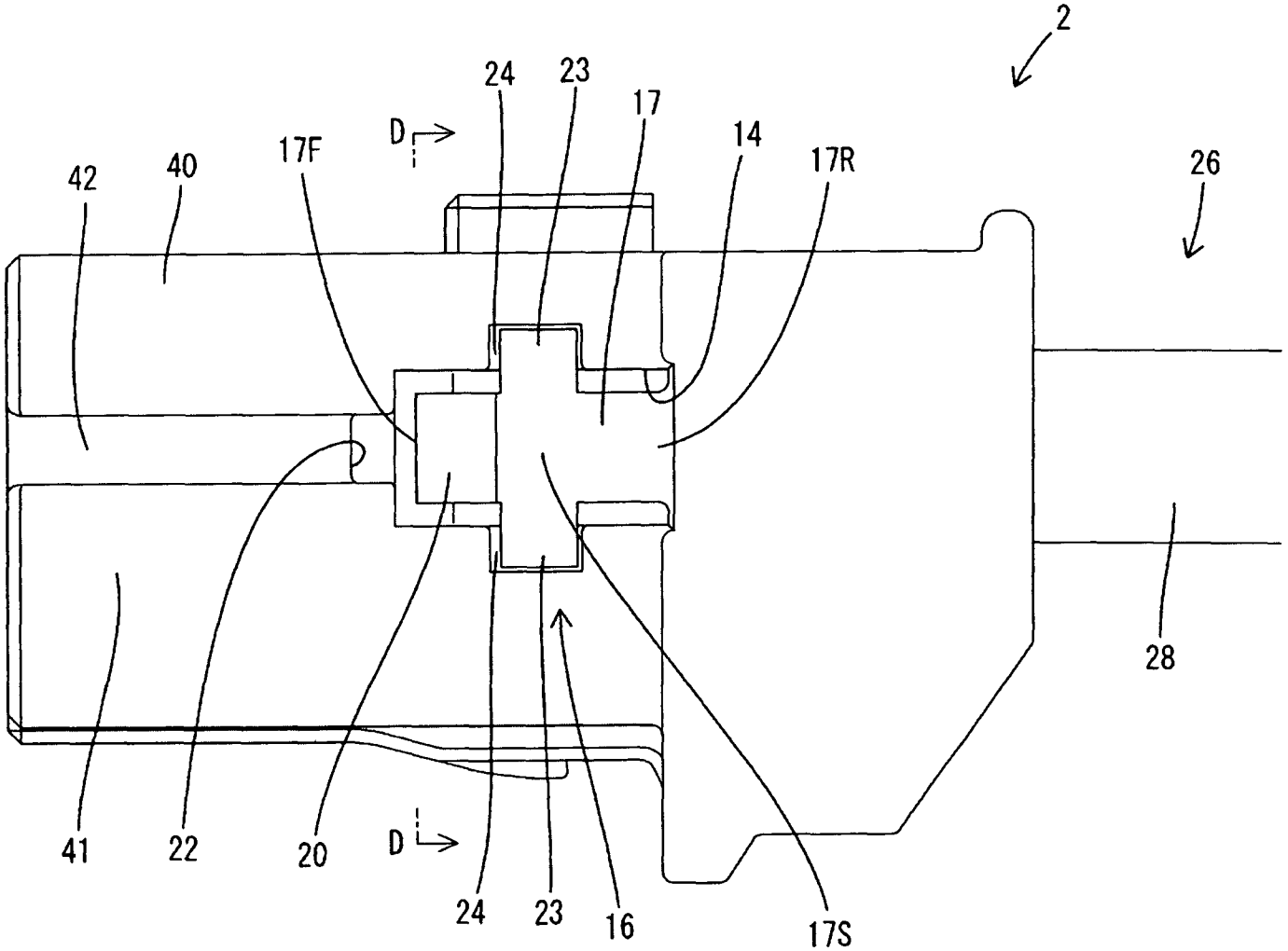
FIG. 9 is a plan view of the connector in the state where the terminal module is properly inserted in the housing.
Figure 10:
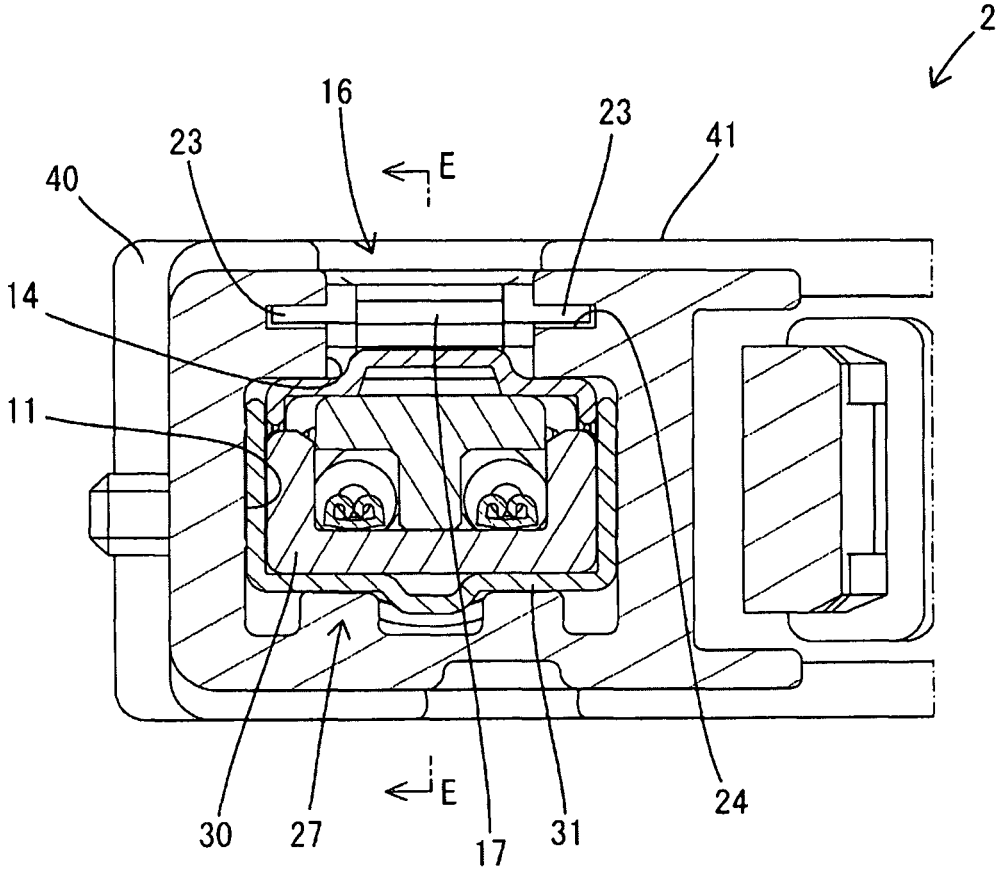
FIG. 10 is a section along D-D of FIG. 9.
Figure 11:
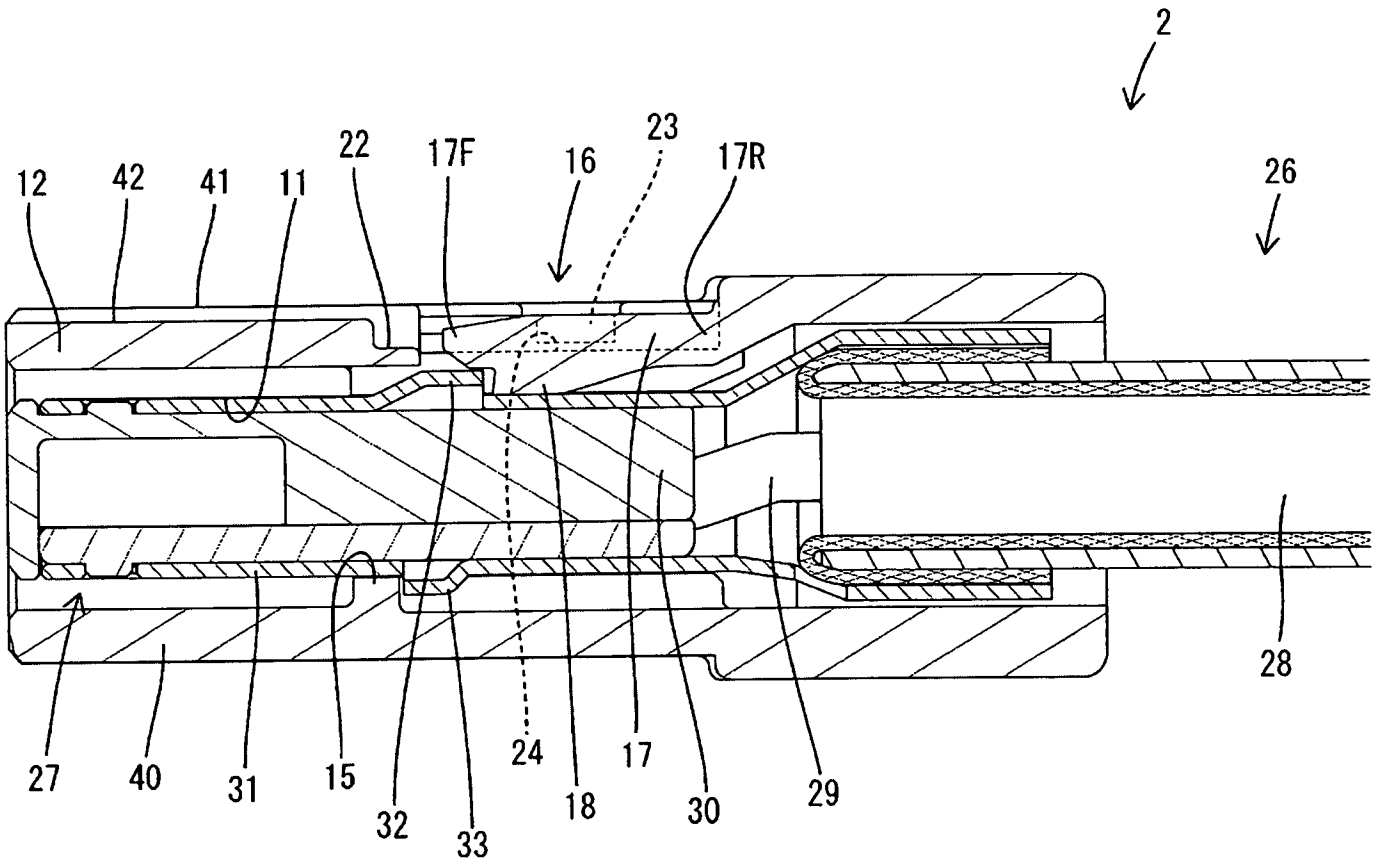
FIG. 11 is a section along E-E of FIG. 10.
Figure 12:
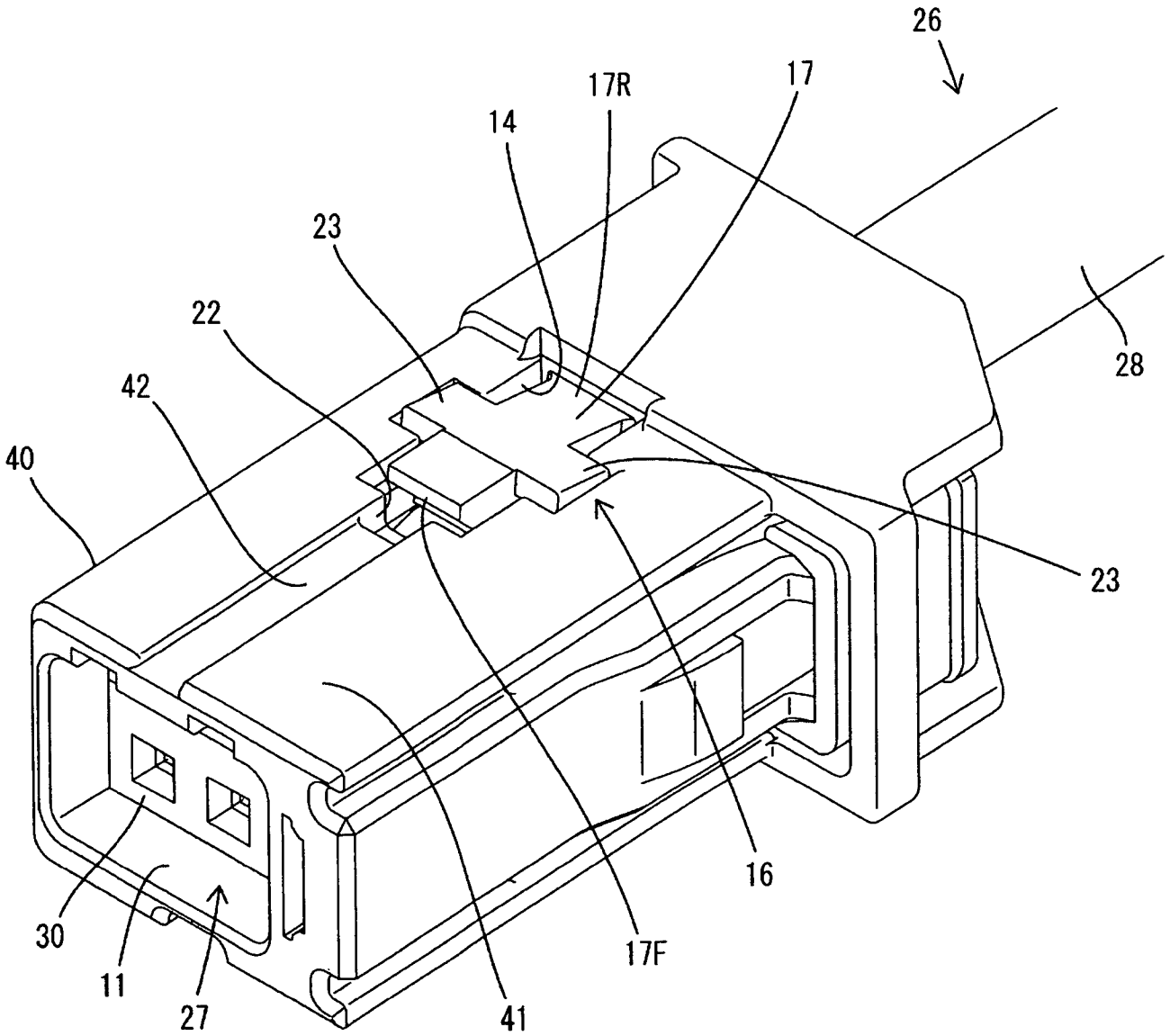
FIG. 12 is a perspective view of the connector in a state where the terminal module is insufficiently inserted.
Figure 13:
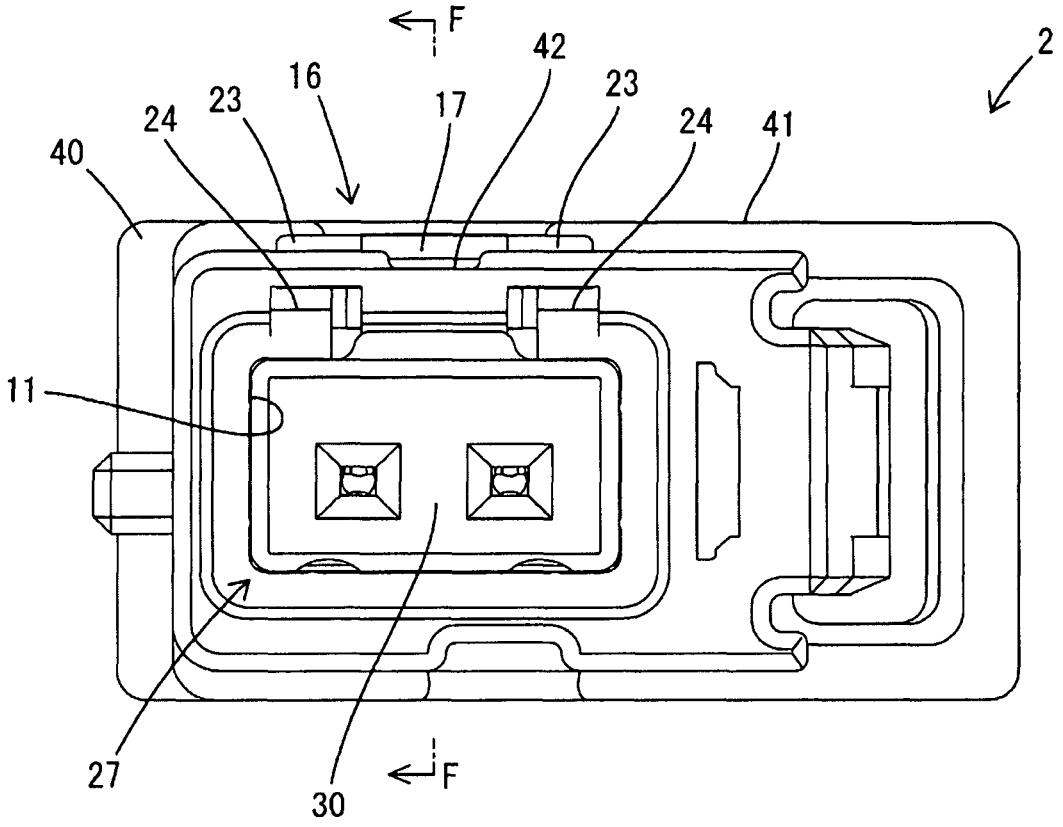
FIG. 13 is a front view of the connector in the state where the terminal module is insufficiently inserted.
Figure 14:
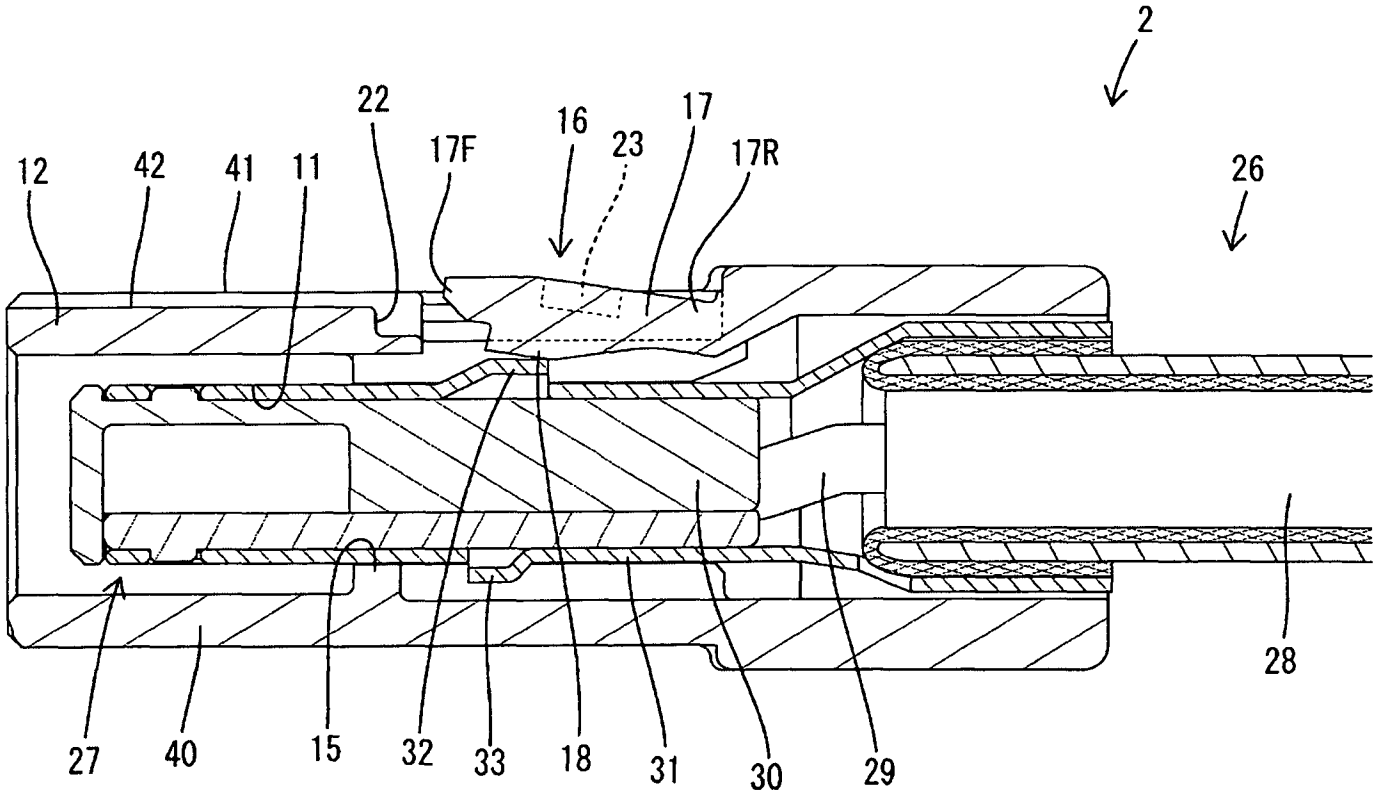
FIG. 14 is a section along F-F of FIG. 13.

A first embodiment of the invention is described with reference to FIGS. 1 to 7. Note that, in the following description, an oblique left-lower side in FIGS. 1 and 5 and a left side in FIGS. 2, 4 and 7 are defined as a front side concerning a front-rear direction. Upper and lower sides shown in FIGS. 1, 3 and 5 to 7 are directly defined as upper and lower sides concerning a vertical direction.

A connector 1 of the first embodiment includes a housing 10 made of synthetic resin and a terminal module 27 (inserting member as claimed) constituting a shielded conductive path 26. The terminal module 27 is inserted into the housing 10 from behind. The shielded conductive path 26 is configured by mounting the terminal module 27 on a front part of a shielded cable 28.

The terminal module 27 includes inner conductors (not shown) individually connected to a twisted pair of wires 29 constituting the shielded cable 28, a dielectric 30 accommodating the inner conductors and an outer conductor 31 surrounding the dielectric 30. The terminal module 27 is formed with a locking projection 32 projecting from the upper surface of the outer conductor 31 and a butting projection 33 projecting from the lower surface of the outer conductor 31.

The housing 10 is in the form of a block and one insertion space 11 is formed inside the housing 10. A front part of the insertion space 11 is open in the front end of the housing 10, and a rear part of the insertion space 11 is open as an insertion opening in the rear end of the housing 10. An upper wall 12 defining the insertion space 11 constitutes an upper surface 13 (outer wall surface as claimed) of the housing 10. The upper wall 12 is formed with a cutout 14 allowing communication between the outside of the housing 10 and the inside of the insertion space 11. The cutout 14 has a rectangular plan view shape long in the front-rear direction (shape viewed from a direction perpendicular to the upper wall surface 13).

The housing 10 is formed with a front stop 15 projecting from the bottom surface of the insertion space 11. The housing 10 is formed integrally with a locking lance 16 cantilevered forward along the ceiling surface of the insertion space 11. The locking lance 16 includes a lance body 17 and left and right restricting portions 23. The lance body 17 has a rectangular plan view shape long in the front-rear direction, similarly to the cutout 14. The lance body 17 constitutes the upper wall 12 of the housing 10 by being accommodated into the cutout 14.

A rear end part 17R of the lance body 17 (base end part of the locking lance as claimed) is connected to a rear of an opening region of the cutout 14, but a front end part 17F (extending end part of the locking lance as claimed) and both left and right side edge parts of the lance body 17 are not in contact with the opening edge of the cutout 14. That is, a slit substantially U-shaped in a plan view is present between an opening edge part of the cutout 14 and the outer peripheral edge of the lance body 17. Specifically, the lance body 17 (locking lance 16) is cantilevered forward and resiliently deformable upward (toward the upper wall surface 13 of the housing 10) with the rear end part 17R of the lance body 17 as a fulcrum.

The lower surface of the lance body 17 is formed with a retaining projection 18. As shown in FIGS. 1 to 4, when the locking lance 16 is at a retaining position (free state) without being resiliently deformed, the retaining projection 18 is located in an insertion path for the terminal module 27 in the insertion space 11. As shown in FIGS. 5 to 7, when the locking lance 16 is at a releasing position by being resiliently displaced upward, the retaining projection 18 is retracted upwardly of the insertion space 11. The front surface of the retaining projection 18 serves as a locking surface 19 and is located a little behind the front end of the lance body 17. The rear end of the retaining projection 18 is located a little in front of the rear end of the lance body 17.

With the locking lance 16 located at the retaining position, the entire area of the upper surface 17S of the lance body 17 (outer surface of the locking lance as claimed) is at a position a little lower than the upper wall surface 13 of the housing 10 (position retracted with respect to the upper wall surface 13). With the locking lance 16 located at the releasing position, an area of the upper surface 27S of the lance body 17 on the side of the front end part 17F is displaced to a position higher than the upper wall surface 13 of the housing 10 (position projecting from the upper wall surface 13).

A guiding slope 20 is formed at a front part (extending end) of the upper surface 17S of the lance body 17 and extends in the front-rear direction (direction parallel to an extending direction of the locking lance 16) from the front end of the lance body 17 to a position a little behind the locking surface 19. When the locking lance 16 is at the retaining position, the guiding slope 20 is inclined down toward the front.

A tool receiving surface 21 is formed at a lower surface (inner surface) of the front part of the lance body 17 and extends in the front-rear direction from the front end of the lance body 17 to a position in front of the locking surface 19. When the locking lance 16 is at the retaining position, the tool receiving surface 21 is inclined up toward the front. Further, the housing 10 is formed with a tool inserting portion 22 by recessing a part (laterally central part) of a front of the cutout 14 in a plan view. The tool receiving surface 21 proximately faces the tool inserting portion 22 in the front-rear direction.

The locking lance 16 is formed integrally with the bilaterally symmetrical restricting portions 23 having a rectangular plan view shape. The restricting portions 23 project laterally out (width direction) from both left and right sides of the lance body 17 and extend in the front-rear direction from a position a little behind the locking surface 19 (position slightly behind the rear end of the guiding slope 20) to a position in front of the rear end of the lance body 17 (position a little in front of the rear end of the retaining projection 18). In other words, the formation region of the restricting portions 23 is only parts of side edges of the locking lance 16 along the extending direction, and the restricting portions 23 are disposed at positions closer to an extending end (front end part 17F) than a base end part (rear end part 17R) in the extending direction of the locking lance 16.

A thickness (dimension in a direction substantially parallel to a resilient deforming direction of the locking lance 16) of the restricting portions 23 is smaller than a maximum thickness of the lance body 17. The upper surfaces of the restricting portions 23 are continuous and flush with an area of the upper surface 17S of the locking lance 16 behind the guiding slope 20. The lower surfaces of the restricting portions 23 are located above the lower surface of the lance body 17.

Since the restricting portions 23 project laterally from both left and right sides of the lance body 17, the restricting portions 23 protrude outwardly of the opening region of the cutout 14 in a plan view. The housing 10 is formed with two bilaterally symmetrical stoppers 24 by recessing both left and right edges of the opening region of the cutout 14 in the upper wall surface 13 of the housing 10 to correspond to the restricting portions 23. The stoppers 24 face up and vertically face the lower surfaces (inner surfaces) of the restricting portions 23.

When the locking lance 16 is at the retaining position, the lower surfaces of the restricting portions 23 face the stoppers 24 with tiny clearances defined therebetween. When the locking lance 16 is resiliently displaced to the releasing position, the restricting portions 23 are displaced up away from the stoppers 24. If the locking lance 16 at the retaining position is displaced toward a side opposite to the releasing position (down), the restricting portions 23 contact the stoppers 24 to restrict any further resilient deformation of the locking lance 16 when the locking lance 16 is slightly displaced down.

Further, the upper wall surface 13 of the housing 10 is formed with left and right detection grooves 25. The detection grooves 25 extend straight in the front-rear direction from the front end of the upper wall surface 13 of the housing 10 toward the left and right restricting portions 23. That is, the detection grooves 25 are located to correspond to the restricting portions 23 with respect to the lateral direction. Rear end parts of the detection grooves 25 communicate with the cutout 14. Groove bottom surfaces of the detection grooves 25 are substantially at the same height as the upper surfaces of the restricting portions 23 when the locking lance 16 is at the retaining position. Therefore, if the locking lance 16 is resiliently deformed to the releasing position, the restricting portions 23 are displaced to positions higher than the groove bottom surfaces of the detection grooves 25.

Next, functions and effects of the first embodiment are described. In assembling the terminal module 27 and the housing 10, the terminal module 27 is inserted into the insertion space 11 from behind the housing 10. If the terminal module 27 reaches an insufficient insertion position immediately before a proper insertion position in an insertion process, the locking projection 32 of the outer conductor 31 contacts the retaining projection 18 of the locking lance 16. Thus, as shown in FIG. 7, the locking lance 16 is displaced resiliently from the retaining position to the releasing position. If the insertion proceeds from this state and the terminal module 27 reaches the proper insertion position, the butting projection 33 of the terminal module 27 butts against the front stop 15 in the insertion space 11 to restrict further insertion of the terminal module 27.

When the terminal module 27 is inserted properly, the locking projection 32 passes over the retaining projection 18. Thus, the locking lance 16 at the releasing position resiliently returns to the retaining position and the locking surface 19 of the retaining projection 18 is locked to the locking projection 32 from behind. In this way, a rearward displacement of the terminal module 27 is restricted and the terminal module 27 is held at the proper insertion position. The retaining projection 18 is in contact with the upper surface of the outer conductor 31 and the lower surface of the front part of the lance body 17 is in contact with the upper surface of the locking projection 32 in this state. Thus, the locking lance 16 at the retaining position is not improperly displaced toward a side opposite to the releasing position (downward).

After the terminal module 27 is mounted into the housing 10, the connector 1 is connected to an unillustrated mating connector (e.g. board connector). The mating connector is formed with detection ribs (not shown) to be fit individually into the detection grooves 25 in a connection process. Thus, there is no possibility that the connector 1 is connected in an improper vertically inverted posture to the mating connector. When the connector 1 is connected properly to the mating connector, tip parts of the detection ribs in a connecting direction are located to cover the upper surfaces of the restricting portions 23.

An inserting operation may be finished with the terminal module 27 left at the insufficient insertion position immediately before reaching the proper insertion position. Thus, the locking projection 32 and the retaining projection 18 are kept interfering with each other, and the locking lance 16 is lifted to the releasing position. If the connector 1 is connected to the mating connector in this state, the detection ribs butt against the front ends of the restricting portions 23. Thus, the connector 1 and the mating connector cannot be connected properly, thereby indicating that the terminal module 27 is in an insufficiently inserted state.

A continuity test conducted for the terminal module 27 (shielded conductive path 26) before the connector 1 is connected to the mating connector will detect the presence of the insufficiently inserted terminal module 27 if the continuity tester is provided with structures similar to the above-described detection ribs.

In withdrawing the terminal module 27 inserted in the housing 10, a tool (not shown) is inserted into the tool inserting portion 22, brought into contact with the tool receiving surface 21 of the locking lance 16 and inclined to resiliently deform the locking lance 16 to the releasing position by the principle of leverage. The retaining projection 18 is disengaged from the locking projection 32 and retracted upwardly of the locking projection 32 if the locking lance 16 is displaced to the releasing position. Thus, the terminal module 27 is released from the retained state. Thereafter, the twisted pair of wires 29 may be gripped and the terminal module 27 may be withdrawn rearward with the locking lance 16 kept displaced to the releasing position.

The connector 1 of the first embodiment includes the housing 10 having the insertion space 11, the terminal module 27 insertable into the insertion space 11 and the locking lance 16. The locking lance 16 is formed in the housing 10 so that the upper surface 17S (outer surface) thereof is exposed to the outside of the housing 10. In the process of inserting the terminal module 27 into the insertion space 11, the locking lance 16 is resiliently deformed toward the outer surface (upper surface 17S) thereof. When the terminal module 27 is inserted properly, the locking lance 16 resiliently returns to retain the terminal module 27.

The locking lance 16 is in contact with the upper surface of the outer conductor 31 with the terminal module 27 inserted in the insertion space 11. Thus, the locking lance 16 is not displaced down (direction to enter the insertion space 11). However, there is no member supporting the locking lance 16 from the side of the insertion space 11 in a state before the terminal module 27 is inserted into the housing 10. Further, the outer surface (upper surface 17S) of the locking lance 16 is exposed to the outside of the housing 10. Thus, if the outer surface (upper surface 17S) of the locking lance 16 is pressed, the locking lance 16 may be deformed improperly to enter the insertion space 11.

As a countermeasure against this, the locking lance 16 is formed with the restricting portions 23. If the locking lance 16 starts being displaced toward the insertion space 11, the restricting portions 23 contact the stoppers 24 of the housing 10 immediately after the start and restrict a displacement of the locking lance 16 toward the insertion space 11. Thus, even if the upper surface 17S of the locking lance 16 is pressed in a state where the terminal module 27 is not inserted in the housing 10 yet, there is no possibility that the locking lance 16 is deformed improperly toward the insertion space 11

Further, the locking lance 16 is cantilevered in the direction substantially parallel to the inserting direction of the terminal module 27 (forward) and the amount of deflection of the locking lance 16 (stress generated in the locking lance 16) is maximized at the rear end part 17R (base end part) when the locking lance 16 is resiliently deformed outwardly due to interference with the terminal module 27. Thus, if the restricting portions 23 are formed on the rear end part 17R of the locking lance 16, the flexural rigidity of the rear end part 17R of the locking lance 16 increases and resistance when the terminal module 27 is inserted increases. In the first embodiment, as a countermeasure against this, the restricting portions 23 are disposed at the positions closer to the front end 17F than the rear end 17R in the extending direction of the locking lance 16. A part of the locking lance 16 on the side of the front end 17F where the restricting portions 23 are formed is deflected less than the rear end part 17R of the locking lance 16. Thus, even if the locking lance 16 is formed with the restricting portions 23, the flexural rigidity when the locking lance 16 is resiliently deformed does not increase and the resistance when the terminal module 27 is inserted also does not increase.

Further, the outer surface of the locking lance 16 (upper surface 17S of the lance body 17) is retracted from the upper wall surface 13 of the housing 10 when the locking lance 16 is in the free state without being resiliently deformed (at the retaining position). Thus, external matter is less likely to interfere with the outer surface (upper surface 17S) of the locking lance 16.

Further, the locking lance 16 is cantilevered substantially parallel to the inserting direction of the terminal module 27. Focusing on this form, the restricting portions 23 project from the both left and right sides of the locking lance 16. According to this configuration, the inclination of the locking lance 16 can be prevented when the left and right restricting portions 23 contact the housing 10 to restrict the resilient deformation of the locking lance 16.

Further, the detection grooves 25 are formed in the upper wall surface 13 of the housing 10 to face the restricting portions 23 displaced according to the resilient deformation of the locking lance 16. The locking lance 16 is deformed resiliently toward the upper surface 17S (outer surface) thereof with the terminal module 27 insufficiently inserted. If mating members (detection ribs or the like of the mating connector) are slid along the detection grooves 25 in this state, the mating members butt against the restricting portions 23. In this way, it can be detected that the terminal module 27 is left insufficiently inserted.

Second Embodiment

A second embodiment of the invention is described with reference to FIGS. 8 to 14. A connector 2 of the second embodiment differs from the above first embodiment in the shape of an upper wall surface 41 (outer wall surface as claimed) of a housing 40. Since the other components are the same as those of the first embodiment, the same components are denoted by the same reference signs and the structures, functions and effects thereof are not described.

Two detection grooves 25 corresponding to the two restricting portions in the lateral direction are formed in the upper wall surface 13 of the housing 10 in the connector 1 of the first embodiment. However, the detection grooves 25 are not formed and only one guide groove 42 is formed in the upper wall surface 41 of the housing 40 in the connector 2 of the second embodiment. The guide groove 42 does not correspond to a pair of restricting portions 23 in the lateral direction and is disposed to correspond to a lance body 17. The rear end of the guide groove 42 faces a tool inserting portion 22. That is, the guide groove 42 communicates with the tool inserting portion 22.

The guide groove 42 was formed, focusing on the point that a locking lance 16 is cantilevered substantially parallel to an inserting direction of a terminal module 27 (forward). The guide groove 42 extends straight from the front of the housing 40 toward a front part 17F (extending end part) of the locking lance 16 formed with a tool receiving surface 21. Thus, to disengage the locking lance 16 from the terminal module 27, a tool (not shown) is guided reliably into the tool inserting portion 22 and slips under the tool receiving surface 21 (inwardly of the front end part 17F of the locking lance 16) if the tool is slid rearward along the guide groove 42. Thus, work efficiency is excellent.

The invention is not limited to the above described and illustrated embodiments. For example, the following embodiments are also included in the technical scope of the present invention.

The restricting portions are disposed at the positions closer to the extending end part than the base end part of the locking lance in the extending direction of the locking lance in the first and second embodiments. However, the restricting portions may be disposed on the base end part of the locking lance.

The restricting portions are disposed only on the parts of the side edge parts of the locking lance along the extending direction in the first and second embodiments. However, the restricting portions may be formed continuously over the entire lengths of the side edge parts of the locking lance.

The outer surface of the locking lance is retracted from the outer wall surface of the housing when the locking lance is in the free state in the first and second embodiments. However, the outer surface of the locking lance may be flush with the outer wall surface of the housing or project from the outer wall surface of the housing.

The restricting portions project from the sides of the locking lance in the first and second embodiments. However, a restricting portion may project forward from the extending end part of the locking lance.

The inserting member is the terminal module in which the dielectric accommodating the inner conductors is surrounded by the outer conductor in the above embodiments. However, the invention can be applied also in the case where the inserting member is the inner conductor and the dielectric is formed with the locking lance or the inserting member is the terminal fitting in an exposed state without being accommodated in the dielectric or the like.

LIST OF REFERENCE SIGNS

1, 2 . . . connector
10, 40 . . . housing
11 . . . insertion space
13, 41 . . . upper wall surface (outer wall surface) of housing
16 . . . locking lance
17F . . . front end part (extending end part) of locking lance
17R . . . rear end part (base end part) of locking lance
17S . . . upper surface (outer surface) of locking lance
23 . . . restricting portion
25 . . . detection groove

27 . . . terminal module (inserting member)
42 . . . guide groove

The invention claimed is:

1. A connector, comprising:

a housing having an insertion space and a stopper facing outward on the housing at a position external of the insertion space;

an inserting member insertable into the insertion space along an inserting direction;

a locking lance formed in the housing and cantilevered substantially along the inserting direction of the inserting member such that an outer surface of the locking lance is exposed to outside of the housing, the locking lance being resiliently deformed toward the outer surface in the process of inserting the inserting member into the insertion space and resiliently returning to retain the inserting member when the inserting member is properly inserted into the insertion space; and a restricting portion formed on the locking lance, the restricting portion restricting a displacement of the locking lance into the insertion space by contacting the stopper of the housing.

2. The connector of claim 1, wherein the outer surface of the locking lance is disposed at a position retracted from an outer wall surface of the housing when the locking lance is in a free state without being resiliently deformed.

3. The connector of claim 1, wherein a detection groove facing the restricting portion displaced according to resilient deformation of the locking lance is formed in an outer wall surface of the housing.

4. The connector of claim 1, wherein:

the locking lance is cantilevered substantially parallel to an inserting direction of the inserting member, and a guide groove extending toward an extending end part of the locking lance is formed in an outer wall surface of the housing.

5. A connector, comprising:

a housing having an insertion space;

an inserting member insertable into the insertion space;

a locking lance formed in the housing and cantilevered substantially parallel to an inserting direction of the inserting member such that an outer surface is exposed to outside of the housing, the locking lance being resiliently deformed toward the outer surface in a process of inserting the inserting member into the insertion space and resiliently returning to retain the inserting member when the inserting member is properly inserted; and a restricting portion formed on the locking lance at a position closer to an extending end part than a base end part of the locking lance in an extending direction of the locking lance, the restricting portion restricting a displacement of the locking lance toward the insertion space by contacting the housing.

6. The connector of claim 5, wherein the outer surface of the locking lance is disposed at a position retracted from an outer wall surface of the housing when the locking lance is in a free state without being resiliently deformed.

7. The connector of claim 6, wherein:

the locking lance has opposite first and second sides, and the restricting portion is a first restricting portion that projects from the first sides of the locking lance, and the locking lance further having a second restricting portion projecting from the second side of the locking lance.

8. The connector of claim 7, wherein a detection groove facing the restricting portion displaced according to resilient deformation of the locking lance is formed in an outer wall surface of the housing.

9. The connector of claim 8, wherein:

a guide groove extending toward an extending end part of the locking lance is formed in an outer wall surface of the housing.

10. A connector, comprising:

a housing having an insertion space;

an inserting member insertable into the insertion space;

a locking lance formed in the housing such that an outer surface is exposed to outside of the housing, the locking lance having opposite first and second sides, and the locking lance being resiliently deformed toward the outer surface in the process of inserting the inserting member into the insertion space and resiliently returning to retain the inserting member when the inserting member is properly inserted; and first and second restricting portions projecting respectively from the first and second sides of the locking lance, the first and second restricting portions restricting a displacement of the locking lance toward the insertion space by contacting the housing, wherein:

the locking lance is cantilevered substantially parallel to an inserting direction of the inserting member into the insertion space.

11. The connector of claim 10, wherein the outer surface of the locking lance is disposed at a position retracted from an outer wall surface of the housing when the locking lance is in a free state without being resiliently deformed.

12. The connector of claim 10, wherein a detection groove facing the restricting portion displaced according to resilient deformation of the locking lance is formed in an outer wall surface of the housing.

* * * * *